US005583510A

United States Patent [19]

Ponnapalli et al.

[11] Patent Number: 5,583,510

[45] Date of Patent: Dec. 10, 1996

[54] PLANAR ANTENNA IN THE ISM BAND WITH AN OMNIDIRECTIONAL PATTERN IN THE HORIZONTAL PLANE

[75] Inventors: Saila Ponnapalli, Fishkill; Alphonso P. Lanzetta, Marlboro, both of N.Y.; Brian P. Gaucher, New Milford, Conn.

[73] Assignee: International Business Machines Corporation, Armonk, N.Y.

[21] Appl. No.: 340,571

[22] Filed: Nov. 16, 1994

[51] Int. Cl.[6] ..... H01Q 1/32

[52] U.S. Cl. ..... 343/700 MS; 343/797

[58] Field of Search ..... 343/700 MS, 793, 343/795, 797; H01Q 1/32

[56] References Cited

U.S. PATENT DOCUMENTS

| | | | |
|---|---|---|---|
| 3,747,114 | 7/1973 | Shyhilla | 343/795 |
| 4,054,874 | 10/1977 | Oltman | 393/700 MS |
| 4,218,682 | 8/1980 | Yu | 343/700 MS |
| 4,329,689 | 5/1982 | Yee | 343/700 MS |
| 4,431,998 | 2/1984 | Finken | 343/797 |
| 4,710,775 | 12/1987 | Cue | 343/793 X |

FOREIGN PATENT DOCUMENTS

| | | | |
|---|---|---|---|
| 6152218 | 5/1994 | Japan | H01Q 1/32 |
| 2092827 | 8/1982 | United Kingdom | 343/700 MS |
| 2152757 | 8/1985 | United Kingdom | 343/700 MS |

*Primary Examiner*—Donald T. Hajec
*Assistant Examiner*—Tho G. Phan
*Attorney, Agent, or Firm*—Whitham, Curtis, Whitham & McGinn; Robert P. Tassinari, Jr.

[57] ABSTRACT

A multilayer antenna includes a first layer which is a ground plane and which has a plurality of first clearance holes. A first dielectric layer is positioned over the first layer and a second layer is positioned over the first dielectric layer and has a plurality of quarter wave transformers. A second dielectric layer is positioned over the second layer and a third layer ground plane is positioned over the second dielectric layer and has a plurality of second clearance holes for a feed structure. A third dielectric layer is positioned over the third layer and a fourth layer is positioned over the third dielectric layer and has a cross shape. The first and third layers are coupled together via plated-through holes.

20 Claims, 8 Drawing Sheets

PLANAR ANTENNA IN THE ISM BAND WITH AN OMNIDIRECTIONAL PATTERN IN THE HORIZONTAL PLANE

BACKGROUND OF THE INVENTION

1. Field of the Invention

The present invention generally relates to planar antennas, and more particularly to multilayer planar antennas having small dimensions and in the industrial, scientific and medical (ISM) band with an omnidirectional pattern in the horizontal plane.

2. Description of the Related Art

The ISM band is currently being used for many medium data rate devices such as local area networks (LANs). Adaptor cards are currently being designed in a Personal Computer Memory Card International Association (PCMCIA) form factor for remote "laptop" computers. These local area networks (LANs) adaptor cards benefit from an elimination of the cabling usually associated wired adaptor cards. They enable one to connect to "backbone" networks such as "Ethernet" and token ring networks.

For wireless products, such as wireless local area network (LAN) adapters, an omnidirectional pattern is desired in the horizontal plane because most adaptors are oriented such that communication between adaptors occurs in this plane. For purposes of this application, the horizontal plane is defined as the plane containing the antenna. Furthermore, the peak power should be in the horizontal plane because this results in the largest maximum distance at which the adaptors would function.

If the LAN has a Personal Computer Memory Card International Association (PCMCIA) form factor, the antenna must have dimensions smaller than 4 cm×5.4 cm for a type II card. Furthermore, the recommended bump should not exceed 10.5 mm in height so that the antenna in the device packaging can be outwardly concealed. For purposes of this application, the "bump" is the height of the extension of the antenna.

Additionally, if the radio uses a spread spectrum approach, as is known in the art, the 84 MHz bandwidth requirement from 2.4 GHz–2.483 GHz in the ISM band must be met by the antenna because the radio utilizes frequencies in this range.

Hitherto the invention, the pattern, form factor and bandwidth restrictions were very difficult to simultaneously meet and no conventional antenna was known which optimized each of these restrictions.

SUMMARY OF THE INVENTION

It is therefore an object of the present invention to provide a multilayer cross antenna.

Another object of the present invention is to provide a multilayer cross antenna in which the pattern, form factor and bandwidth restrictions are optimized simultaneously.

Yet another object of the present invention is to provided a multilayer planar antenna having small dimensions (e.g., on the order of 3.8 cm. by 0.486 cm.) and for use in the industrial, scientific and medical (ISM) band with an omnidirectional pattern in the horizontal plane.

In a first aspect of the invention, an antenna is provided according to the present invention which includes a plurality (e.g., first through fourth) conducting layers. From the top layer to the bottom layer, the structure includes a top (e.g., fourth) layer of the antenna which is a radiating cross antenna, a third layer which is a ground plane, a second layer which is a feed network including a plurality (e.g., three) of quarter wave transformers feeding four feed points on the top layer, and a bottom (e.g., first) layer which is a ground plane.

In another aspect of the invention, a multilayer antenna is provided according to the present invention which a first layer which is a ground plane and which has a plurality of first clearance holes. A first dielectric layer is positioned over the first layer and a second layer is positioned over the first dielectric layer and has a plurality of quarter wave transformers. A second dielectric layer is positioned over the second layer and a third layer ground plane is positioned over the second dielectric layer and has a plurality of second clearance holes for a feed structure. A third dielectric layer is positioned over the third layer and a fourth layer is positioned over the third dielectric layer and has a cross shape. The first and third layers are coupled together with plated-through holes.

With the inventive structure, the pattern, form factor and bandwidth restrictions are optimized simultaneously.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
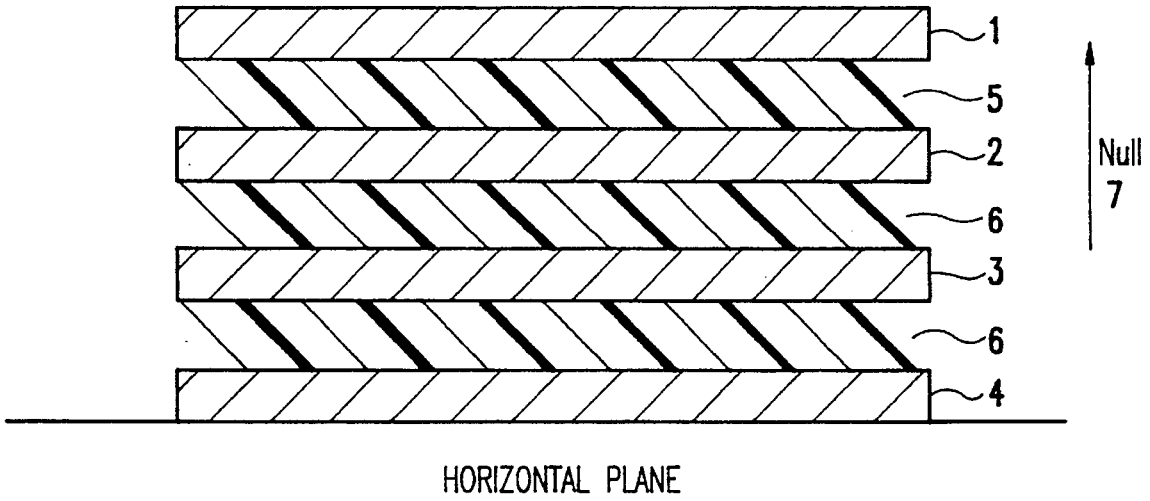
FIG. 1 is a cross-section of an antenna according to an embodiment of the present invention.

Referring now to the drawings, and more particularly to FIG. 1, there is shown a cross-section of a multilayer planar antenna according to the present invention having small dimensions (e.g., on the order of 3.8 cm. by 0.48 cm.) and for use in the industrial, scientific and medical (ISM) band with an omnidirectional pattern in the horizontal plane.

The planar antenna of the invention preferably has an exemplary doughnut-shaped antenna pattern, which is advantageous since the peak radiation is in the horizontal plane and thus both remote components (e.g., respective receivers and transmitters) are both in this plane as well. Of course, the pattern of the antenna can be suitably designed and modified to have a shape different from the doughnut shape shown in FIG. 1, as is known by one of ordinary skill in the art within the purview of this application.

Generally, the antenna includes a plurality of layers. More specifically and looking at the structure from the top down, a top (e.g., fourth) layer 1, a third layer 2, a second layer 3, and a bottom (e.g., first) layer 4. Dielectric 5, 6 separate the layers from one another as shown in FIG. 1. In a preferred embodiment, dielectric 5 preferably has a thickness of 0.125 mils, whereas dielectric 6 preferably has a thickness of 0.031 mils.

Thus, the antenna is formed on a substrate (e.g., dielectric layer 5) which preferably is 0.125 mils thick epoxy polyphenylene oxide resin sold under the name GETEK by General Electric Corporation. On the top surface of the substrate is the metalization layer 1 which defines the geometry of the antenna. The bottom surface of the first dielectric layer is covered by metalization layer 2 which acts as a ground plane for the antenna. The metal layers 1, 2 are typically 0.7 mils and 1.4 mils in thickness, respectively, and are formed by well-known plating and etching techniques. The second and third metal layers (and the third and fourth metal layers) are likewise separated by a dielectric material layer. The bottom surface of the third dielectric layer is also covered by metalization layer 4 which acts as a ground plane for the antenna. The first, second third and fourth layers are formed by well-known plating and etching techniques.

The null 7 is in the direction along the axis perpendicular to the plane of the antenna. In a preferred embodiment, the antenna is preferably 3.8 cm×3.8 cm in dimension and 4.86 mm thick. The design avoids buried vias, and all vias are plated through holes.

Figure 2:
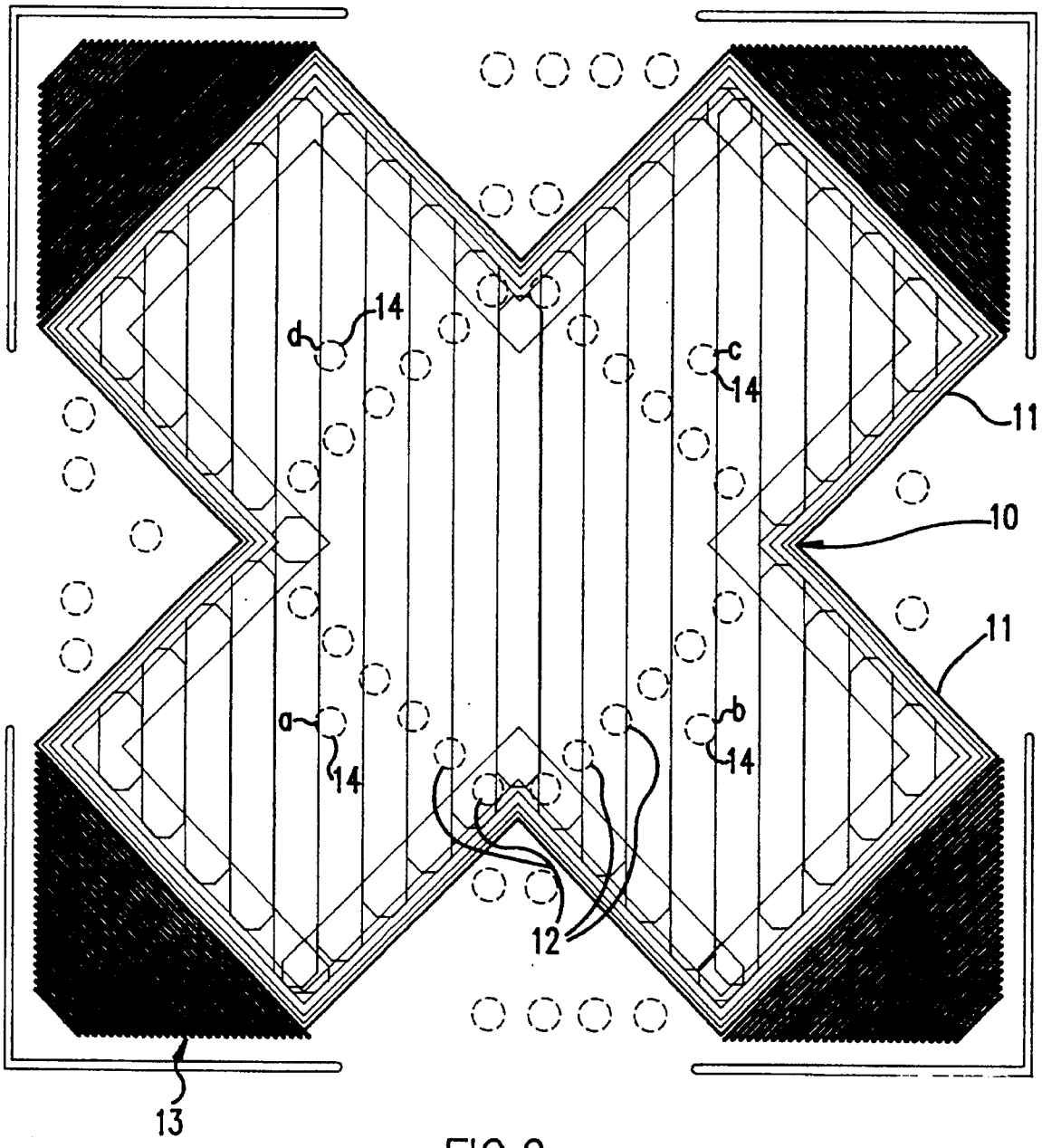
FIG. 2 is a plan view of the first (e.g., top) layer of the antenna shown in FIG. 1.

The top layer 1 is shown in greater detail in FIG. 2 having a plurality of arms 11 which form a cross-shape 10 which is diagonally placed within a 3.8-cm×3.8-cm area. The top layer can be formed to have other shapes as desired by the designer. The cross shape is preferably selected because it supports a $TM_{20}$ mode across it which results in a doughnut shaped radiation pattern.

The top layer 1 is preferably composed primarily (if not entirely) of copper and/or an alloy thereof and preferably includes approximately one half ounce of copper having a thickness of 1.7 mils. In lieu of substantially pure copper, copper alloys may also be advantageously used alternatively or additionally to the pure copper. Further, other conductive materials, as are known in the art, may be suitably used.

In the preferred embodiment, each arm 11 of the cross is preferably approximately 1.55 cm wide as shown in FIG. 2. Of course, the invention is scalable with the frequency employed, as would be evident to one of ordinary skill in the art within the purview of this application. Further, it is noted that the dimensions used above are scaled to the frequency employed and thus the invention is scalable.

There are via holes 12 to the ground plane in a square pattern at the center of the antenna to enhance the radiating mode. The cross is fed at four different positions a–d. The symmetric feed positions help in field cancellation along the axis, so that a doughnut-shaped radiation pattern is produced.

The ends of the cross 13 are "grated", that is they have 5-mil gaps which capacitively couple to each other. This structure serves to increase the bandwidth of the antenna by 60%. The resonant length is determined by the length between the feed point and the end of the arm. The striations allow at different resonant lengths to exist in the 2.4–2.484 GHz range.

Figure 3:
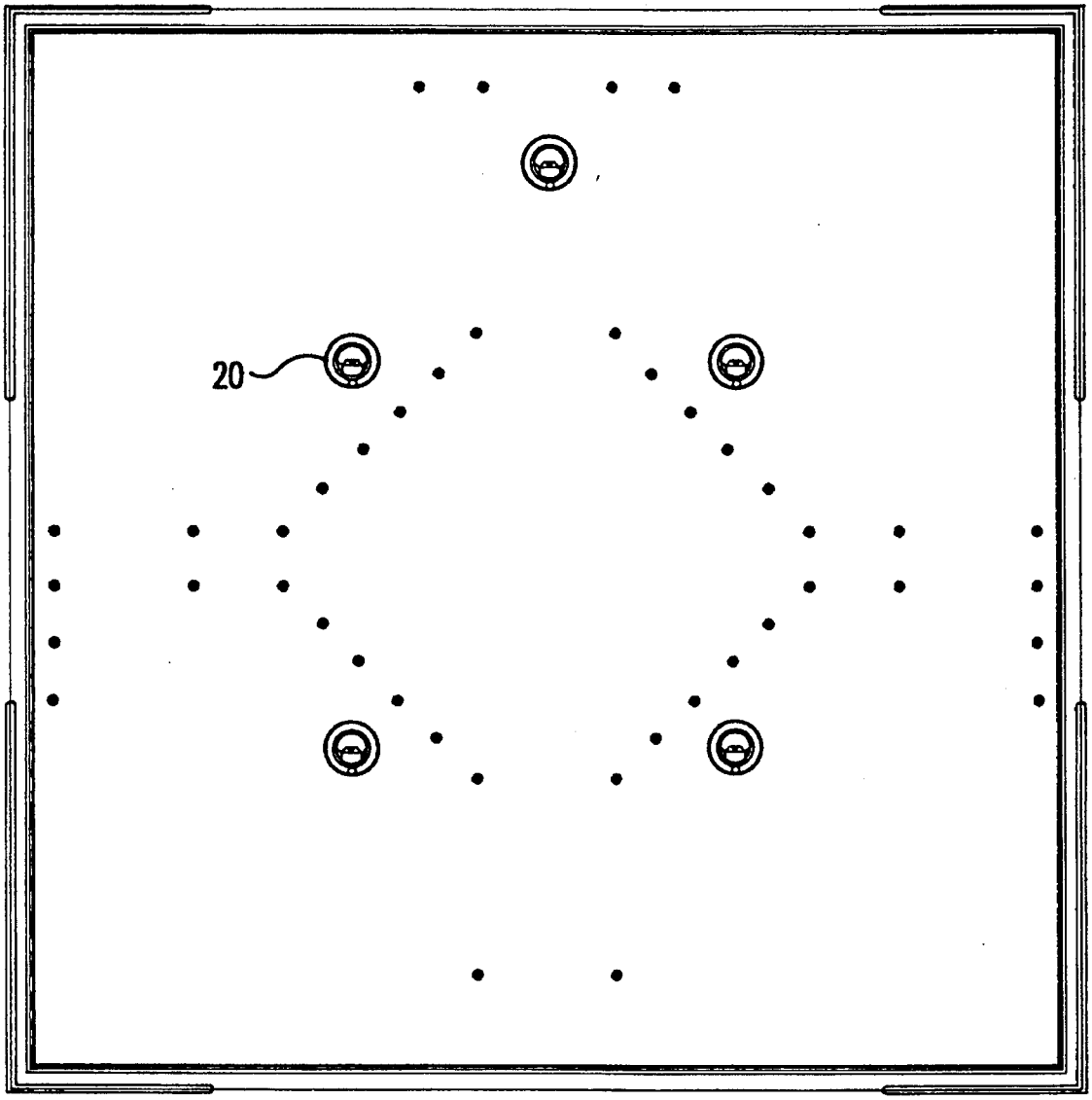
FIG. 3 is a plan view of the second layer of the antenna shown in FIG. 1.

The metal layer 2 preferably includes one ounce of copper (or an alloy thereof) having a thickness of 2.6 mils and is shown in detail in FIG. 3. The metal layer 2 is a ground plane with clearance holes 20 for the feed structure, the external feed and the vias tying the layers 2, 4 together.

Figure 4:
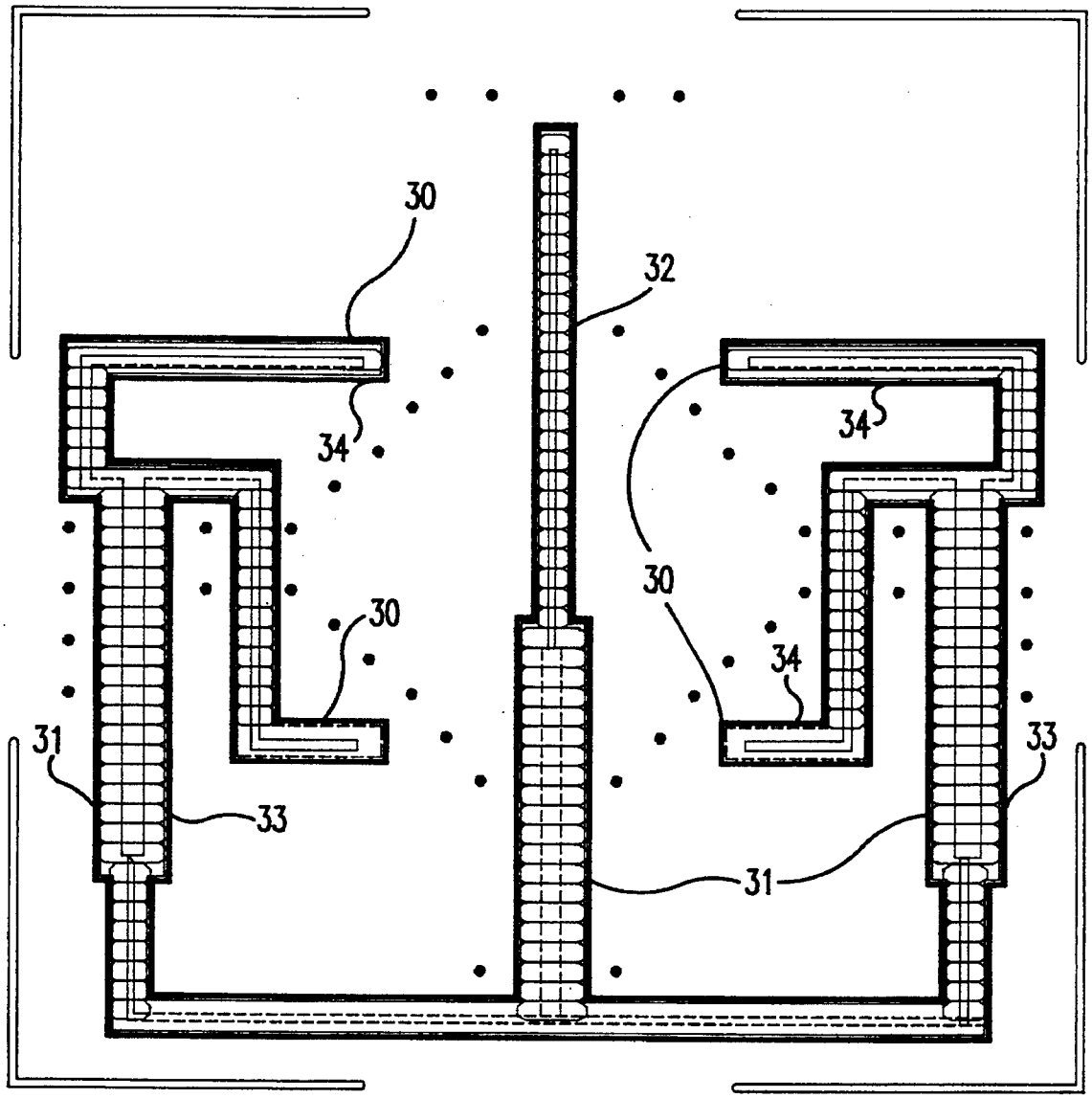
FIG. 4 is a plan view of the third layer of the antenna shown in FIG. 1.

The metal layer 3 preferably includes one ounce of copper (or an alloy thereof) and preferably has a thickness of 1.4 mils. The layer 3 is shown in detail in FIG. 4 where a feed network 30 including a plurality (e.g., three) of quarter wave transformers 31 is shown. A line 32 preferably having a resistance of substantially 50 ohms is preferably used to connect to a 35.35-ohm (or the like) quarter wave transformer 31, which splits the power to two 50-ohm lines.

These two 50-ohm lines are in turn split using two more quarter wave transformers 33 to two 50-ohm lines 34 resulting in a four-way split in power. The length of the transmission lines is enforced to be equal so that all the feed points receive an in phase signal. The four feed points on the top antenna are fed with these four lines.

Figure 5:
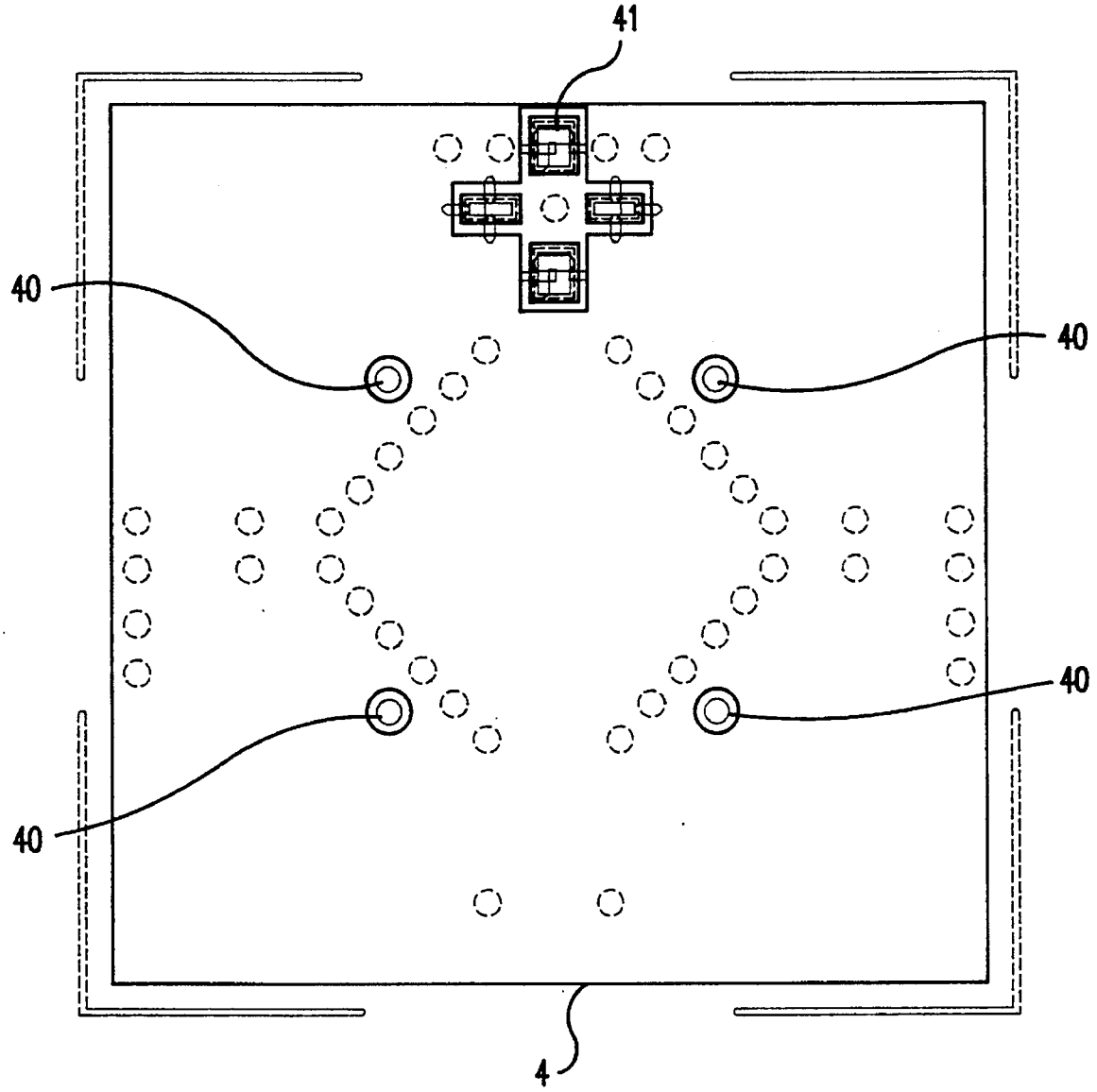
FIG. 5 is a plan view of the fourth (e.g., bottom) layer of the antenna shown in FIG. 1.

The bottom layer 4 preferably includes one ounce of copper (or an alloy thereof) and preferably has a thickness of 1.4 mils and is shown in more detail in FIG. 5. The bottom layer 4 is typically built on a substrate of suitable material as is known in the art. The bottom layer 4 is a ground plane and has clearance holes 40 for the feed network and a pad 41 for the surface mount connector at the bottom. Further, FIG. 5 shows plate holes (unreferenced) for connecting the ground planes together. In lieu of substantially pure copper or copper alloys for the first through the fourth metal layers, other conducting materials may also be advantageously used alternatively or additionally to the copper or its alloys.

As mentioned above and as shown in FIG. 1, between each layer is a layer of dielectric. The dielectric layer 5 between layers 1, 2 layers preferably has a thickness of 0.125 mils. The other dielectric layers 6 preferably have a thickness of 0.031 mils. The 0.125 mils thickness of layer 5 aids in increasing the bandwidth of the antenna while the 0.031 mils thickness for the feed network aids in obtaining manufacturable line widths.

The fabrication of the antenna is conducted with known methods. Briefly, the antenna is fabricated using an etch process for each 2-layer structure, and then bonding the layers together using prepreg.

Figure 6:
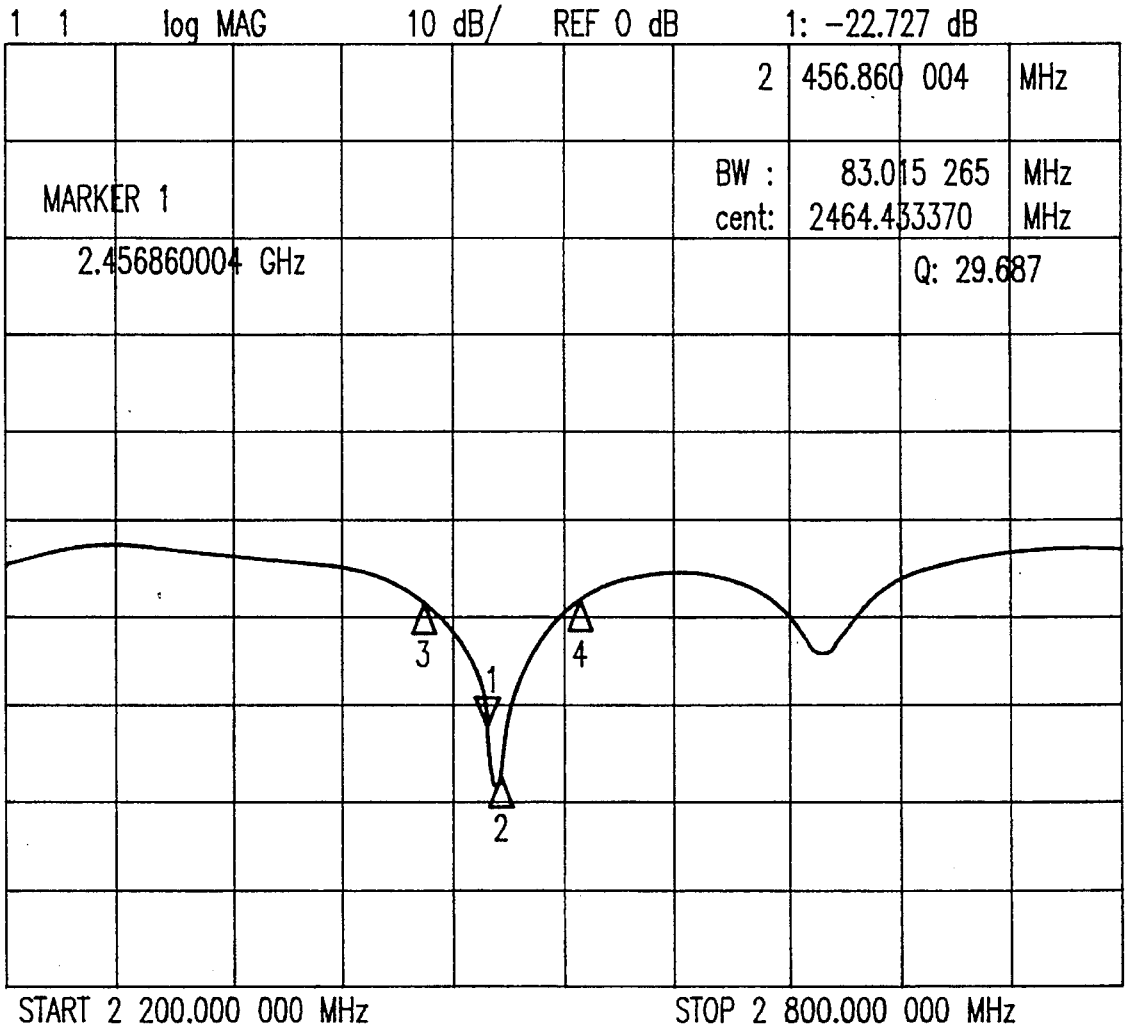
FIG. 6 is a graph of the measured reflection coefficient of the antenna showing a bandwidth of 84 MHz.

The multilayer cross antenna was fabricated using a GETEK material, commercially available from General Electric, as the dielectric and exactly as described above. The dielectric has a dielectric constant of 4.2. The measured bandwidth is shown in FIG. 6 with the radome and finite size card corresponding to the ground plane of the radio card.

The unexpected advantages of this structure of the invention include that a bandwidth of 3.4% can be achieved. This is significant in that usually microstrip antennas having a similar thickness and dimensions have a much smaller bandwidth than 3.4% (e..g, on the order of 2%).

Figure 7:
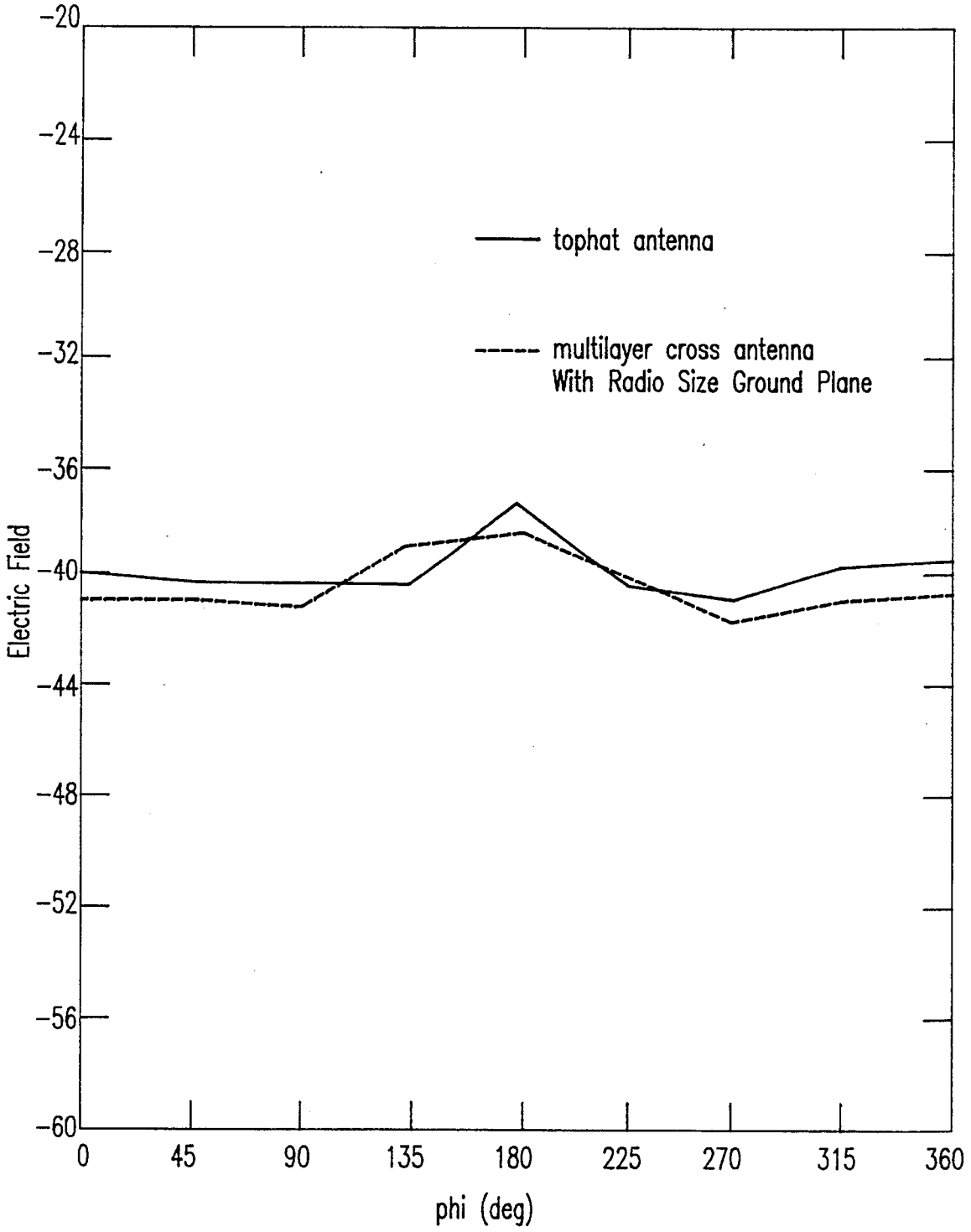
FIG. 7 is the radiating field pattern in the horizontal plane pattern of the antenna, superimposed on a "tophat" monopole antenna.
Figure 8:
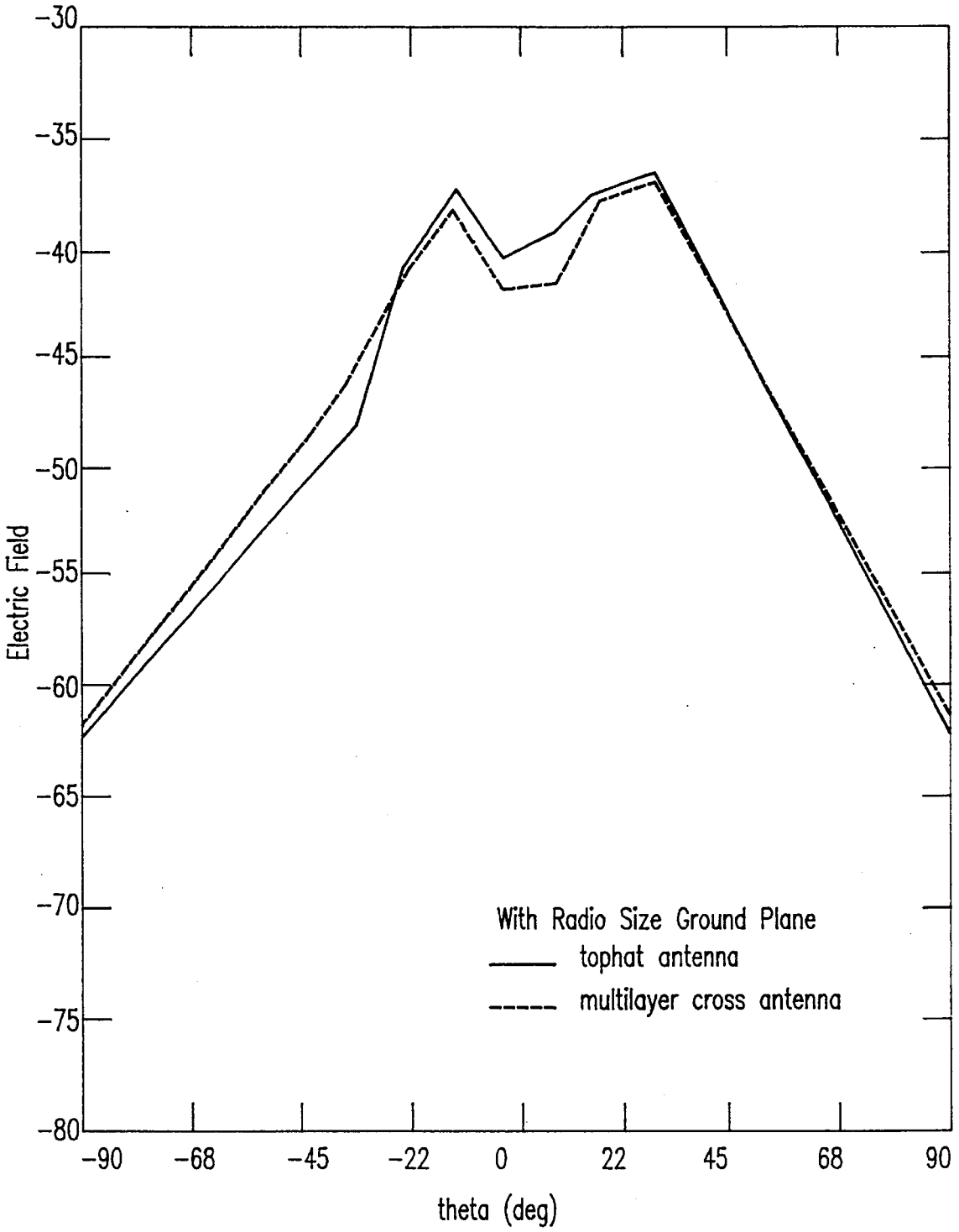
FIG. 8 is the radiating field pattern of the vertical plane of the antenna, superimposed on a pattern of a "tophat" monopole antenna.

The radiating field pattern was measured with the finite size ground plane, and is shown in FIGS. 7 and 8, with the differences between a "tophat" antenna configuration and a multilayer cross antenna being illustrated.

The radiating pattern has a doughnut shape, as exemplified by FIG. 7, which shows a 3 dB ripple in the horizontal plane and the elevation plot in FIG. 8 which shows that the null (–64 dB transferred power at a distance of two meters) is in the axial direction.

Other features of the present invention include a unique doughnut-shaped pattern achieved with a very small (as compared with the conventional antennas) antenna. Further, the antenna is primarily for far-field applications.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A multilayer antenna, comprising:

a first layer being a ground plane and having a plurality of first clearance holes;

a first dielectric layer positioned over said first layer;

a second layer positioned over said first dielectric layer and having a plurality of quarter wave transformers connected to a plurality of transmission lines, each transmission line of said plurality of transmission lines outputting a signal and each said transmission line outputting said signal in phase;

a second dielectric layer positioned over said second layer;

a third layer ground plane positioned over said second dielectric layer and having a plurality of second clearance holes for a feed structure;

a third dielectric layer positioned over said third layer; and a fourth layer positioned over said third dielectric layer and having a cross shape, said first and third layers being coupled together via said first and second clearance holes, wherein said fourth layer includes a plurality of feed points for receiving said signal, and said antenna producing a linearly polarized radiation pattern perpendicular to said fourth layer.

2. A multilayer antenna according to claim 1, wherein said antenna has a doughnut-shaped radiating pattern.

3. A multilayer antenna according to claim 1, wherein said first layer comprises at least one of copper and a copper alloy.

4. A multilayer antenna according to claim 3, wherein said second layer comprises at least one of copper and a copper alloy.

5. A multilayer antenna according to claim 4, wherein said third layer comprises at least one of copper and a copper alloy.

6. A multilayer antenna according to claim 5, wherein said fourth layer comprises at least one of copper and a copper alloy.

7. A multilayer antenna according to claim 1, wherein said antenna has dimensions of 3.8 cm by 3.8 cm and has a thickness of substantially 4.86 mm.

8. A multilayer antenna according to claim 1, wherein said fourth layer includes a plurality of arms thereby forming said cross shape, each of said arms having a width of 1.55 mm.

9. A multilayer antenna according to claim 1, wherein said first and second dielectric layers each have a thickness of 0.031 mils.

10. A multilayer antenna according to claim 1, wherein said third dielectric layer has a thickness of 0.125 mils.

11. A multilayer antenna according to claim 8, wherein ends of said arms are grated and said antenna comprises a single antenna element.

12. A multilayer antenna according to claim 1, wherein said first, second and third dielectric layers each comprise epoxy polyphenylene oxide resin.

13. A multilayer antenna for embedding into a peripheral of a computer system, comprising:

a first layer being a ground plane and having a plurality of first clearance holes;

a first dielectric layer mounted on said first layer;

a second layer mounted on over said first dielectric layer and having a plurality of quarter wave transformers connected to a plurality of transmission lines, each transmission line of said plurality of transmission lines outputting a signal and each said transmission line outputting said signal in phase;

a second dielectric layer mounted on said second layer;

a third layer ground plane mounted on said second dielectric layer and having a plurality of second clearance holes for a feed structure;

a third dielectric layer mounted on said third layer; and a fourth layer mounted on said third dielectric layer and having a cross shape, said first and third layers being coupled together via plated-through holes, said first, second, third and fourth layers each comprising at least one of copper and a copper alloy, wherein said fourth layer includes a plurality of feed points for receiving said signal, and said antenna producing a linearly polarized radiation pattern perpendicular to said fourth layer.

14. A multilayer antenna according to claim 13, wherein said second layer is coupled to a quarter wave transformer via a line having a predetermined resistance for splitting power to two transmission lines, said two transmission lines being split using second and third transformers, thereby resulting in a four-way power split, a length of said transmission lines being equal such that all feed points receive an in phase signal.

15. A multilayer antenna according to claim 14, wherein said fourth layer is a top layer and includes a plurality of feed points for receiving said transmission lines, said first layer being a bottom layer and including a pad for a surface mount connector at a surface thereof.

16. A multilayer antenna according to claim 15, wherein said antenna has a doughnut-shaped radiating pattern and has dimensions of 3.8 cm. by 3.8 cm. and has a thickness of substantially 4.86 mm and wherein said fourth layer includes a plurality of arms thereby forming said cross shape, each of said arms having a width of 1.55 mm.

17. A multilayer antenna according to claim 16, wherein said first and second dielectric layers each have a thickness of 0.031 mils.

18. A multilayer antenna according to claim 17, wherein said third dielectric layer has a thickness of 0.125 mils.

19. A multilayer antenna according to claim 18, wherein ends of said arms are grated and said antenna comprises a single antenna element.

20. A multilayer antenna according to claim 19, wherein said first, second and third dielectric layers each comprise epoxy polyphenylene oxide resin.

* * * * *